US012129871B2

(12) United States Patent
Horsfall et al.

(10) Patent No.: US 12,129,871 B2
(45) Date of Patent: Oct. 29, 2024

(54) MOLTEN METAL PUMP

(71) Applicant: PYROTEK, INC, Spokane, WA (US)

(72) Inventors: Andrew Horsfall, Cuyahoga Falls, OH (US); Jason Tetkoskie, Cleveland Hts., OH (US)

(73) Assignee: PYROTEK, INC., Spokane, WA (US)

( * ) Notice: Subject to any disclaimer, the term of this patent is extended or adjusted under 35 U.S.C. 154(b) by 179 days.

(21) Appl. No.: 17/774,362

(22) PCT Filed: Nov. 4, 2020

(86) PCT No.: PCT/US2020/058867

§ 371 (c)(1),
(2) Date: May 4, 2022

(87) PCT Pub. No.: WO2021/092005

PCT Pub. Date: May 14, 2021

(65) Prior Publication Data

US 2022/0403846 A1 Dec. 22, 2022

Related U.S. Application Data

(60) Provisional application No. 62/930,349, filed on Nov. 4, 2019.

(51) Int. Cl.
*F04D 7/06* (2006.01)
*F04D 29/10* (2006.01)
(Continued)

(52) U.S. Cl.
CPC ..... *F04D 7/065* (2013.01); *F04D 29/106* (2013.01); *F04D 29/445* (2013.01); *B22D 35/00* (2013.01)

(58) Field of Classification Search
CPC ..... F04D 7/065; F04D 29/104; F04D 29/445; F04D 29/449; B22D 35/00
See application file for complete search history.

(56) References Cited

U.S. PATENT DOCUMENTS 3,291,473 A 12/1966 Sweeney et al.
4,940,384 A * 7/1990 Amra ..... F04D 7/065 415/121.2

(Continued)

FOREIGN PATENT DOCUMENTS

JP 2002048096 A 2/2002
JP 2002371984 A 12/2002
KR 101693509 B1 1/2017

OTHER PUBLICATIONS

International Search Report for Application No. PCT/US2020/058867, mailed Feb. 22, 2021, 2 pages.

(Continued)

*Primary Examiner* — Charles G Freay
(74) *Attorney, Agent, or Firm* — Lippes Mathias LLP

(57) ABSTRACT

A molten metal pump having a base member defining a pumping chamber is provided. The pumping chamber includes an opening in each of a top surface and a bottom surface of the base member. An impeller is disposed in the pumping chamber and is configured to draw molten metal through the opening in the bottom surface and expel the molten metal through an outlet in the base member. A flow diverter is disposed above the opening in the top surface.

17 Claims, 4 Drawing Sheets

(51) Int. Cl.
*F04D 29/44* (2006.01)
*B22D 35/00* (2006.01)

(56) References Cited

U.S. PATENT DOCUMENTS

| | | | | |
|---|---|---|---|---|
| 6,354,796 | B1 * | 3/2002 | Morando | F04D 7/065 415/206 |
| 9,970,442 | B2 | 5/2018 | Tipton | |
| 2017/0241713 | A1 | 8/2017 | Henderson et al. | |

OTHER PUBLICATIONS

European Search Report for PCT/US2020/058867, dated Nov. 6, 2023, 6 pages.

* cited by examiner

MOLTEN METAL PUMP

BACKGROUND

The present exemplary embodiment relates to an assembly for pumping molten metal. It finds particular application in variable pressure filling molds with molten metal, and will be described with particular reference thereto. However, it is to be appreciated that the present exemplary embodiment is also amenable to other similar applications.

At times it is necessary to move metal in its liquid or molten form. Molten metal pumps can be utilized to transfer molten metal through a system of pipes or launders. These pumps often include a base member suspended below a motor in a bath of molten metal wherein a rotatable elongated shaft rotates an impeller in the base member. The impeller is mounted within a chamber formed in the base member. The impeller can be supported by bearing rings to allow smooth rotation and act as a wear resistant surface. The motor can be supported by a platform that is rigidly attached to at least one structural post that suspends the base member. Rotation of the impeller causes a directed flow of molten metal through an outlet in the base member which can be used to fill a mold or other receptacle.

Although centrifugal pumps operate satisfactorily to pump molten metal, they have only recently found acceptance as a means to fill molds, particularly molds having complex geometry. An exemplary centrifugal pump used to fill complex molds is described in U.S. Pat. No. 9,970,442, herein incorporated by reference. While highly effective in efficiently filling complex molds, the above referenced centrifugal pump has been found on occasion to experience undesirable turbulence on the surface of the molten metal bath. The present disclosure helps to reduce unwanted molten metal bath surface turbulence.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

According to a first embodiment, a molten metal pump having a base member defining a pumping chamber is provided. The base member includes an opening in each of a top surface and a bottom surface in fluid communication with the pumping chamber. At least one part extends between a motor mount and the base member. An impeller is disposed in the pumping chamber and is configured to draw molten metal through the opening in the bottom surface and expel the molten metal through an outlet in the base member. A flow diverter is disposed above the opening in the top surface.

According to another embodiment, a method of pumping molten metal is described. The method involves providing a molten metal pump having a base member defining a pumping chamber. The base member includes an opening in a top surface and an opening in a bottom surface. The openings are in fluid communication with the pumping chamber. An impeller is disposed in the pumping chamber and rotation of the impeller draws molten metal through the opening in the bottom surface and expels molten metal through an outlet in the base member when operated at 200 RPM or lower. The impeller also expels the molten metal through the opening in the top surface when operated at 500 RPM or higher. A flow diverter is disposed above the opening in the top surface to direct molten metal passing through the opening in the top surface laterally.

According to a further embodiment, a molten metal pump having a base member defining a pumping chamber is provided. The base member includes an opening in a top surface and an opening in a bottom surface. The openings are in fluid communication with the pumping chamber. At least one post extends between a motor mount and the base member. An impeller is disposed in the pumping chamber and is configured to draw molten metal through the opening in the bottom surface and expel the molten metal through an outlet in the base member. A flow diverter is supported above the opening in the top surface by a spacer element in the form of a cylindrical body including passages therethrough.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
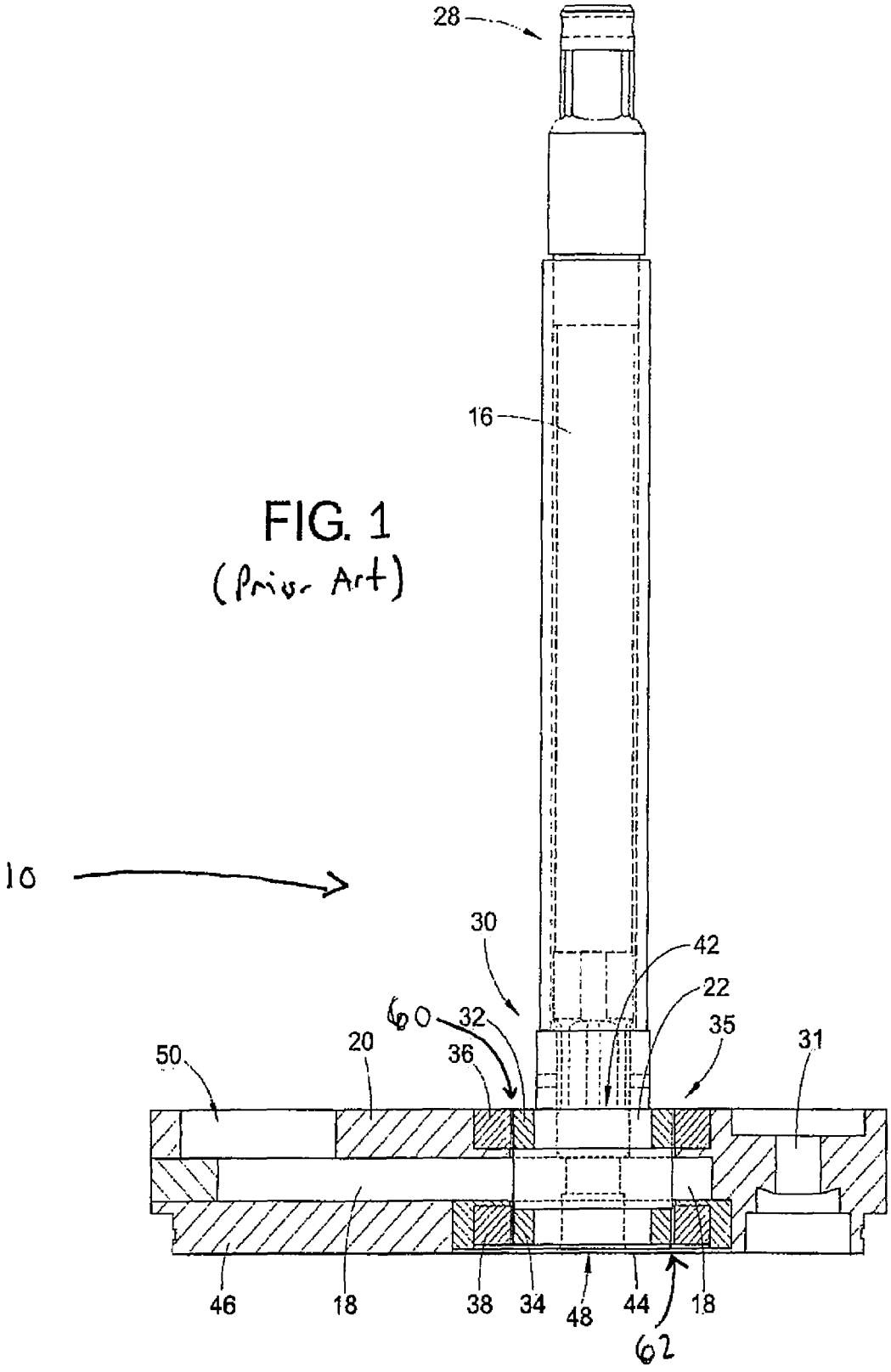
FIG. 1 (Prior Art)
FIG. 1 illustrates a cross sectional view of a prior art molten metal pump used for filling molds with molten metal.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used herein, the terms about, generally and substantially are intended to encompass structural or numerical modifications which do not significantly affect the purpose of the element or number modified by such term.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

With reference to FIG. 1, elements of a molten metal pump assembly 10 suitable for use in the present disclosure are illustrated. As used herein, the term "molten metal" will be understood to mean any metal, such as aluminum, copper, iron, magnesium and alloys thereof, which are amendable for casting, dosing or similar applications. An elongated shaft 16 has a cylindrical shape with a rotational axis that is generally perpendicular to the base member 20. The elongated shaft has a proximal end 28 that is adapted to attach to a motor by a coupling and a distal end 30 that is connected to an impeller 22. The impeller 22 is notably positioned within a pump chamber 18 such that operation of the motor rotates the elongated shaft 16 which rotates the impeller 22 within the pump chamber 18.

The base member 20 defines the pump chamber 18 that receives the impeller 22. The base member 20 is configured to structurally receive refractory posts (optionally comprised of an elongated metal rod within a protective refractory sheath) within passage(s) 31. Each passage 31 is adapted to receive the metal rod component of the refractory post to rigidly attach to a motor mount. The motor mount supports the motor above the molten metal bath and suspends the base member within the bath.

In one embodiment, the impeller 22 is configured with a first radial edge 32 that is axially spaced from a second radial edge 34. The first and second radial edges 32, 34 are located peripherally about the circumference of the impeller 22. The pump chamber 18 includes a bearing assembly 35 having a first bearing ring 36 axially spaced from a second bearing ring 38. The first radial edge 32 is facially aligned with the first bearing ring 36 and the second radial edge 34 is facially aligned with the second bearing ring 38. The radial edges of the impeller may be comprised of a material such as silicon carbide. For example, the radial edges of the impeller 22 may be bearing ring. At least one bearing can be adapted to support the rotation of the impeller 22 within the base member. The bearing rings 36, 38 can be made of a material such as silicon carbide having frictional bearing properties at high temperatures to prevent cyclic failure. Generally speaking, all components of the pump intended for submergence in the molten metal bath can be constructed of a refractory material such as graphite or ceramic (e.g. silicon carbide).

In one embodiment, the impeller 22 includes a first peripheral circumference 42 axially spaced from a second peripheral circumference 44. The elongated shaft 16 is attached to the impeller 22 at the first peripheral circumference 42. The second peripheral circumference 44 is spaced opposite from the first peripheral circumference 42 and aligned with a bottom portion 46 of the base member 20. The first radial edge 32 is adjacent to the first peripheral circumference 42 and the second radial edge 34 is adjacent to the second peripheral circumference 44.

A bottom inlet 48 is provided in the second peripheral circumference 44. In this exemplary embodiment, the inlet comprises the annulus of a bird cage style of impeller. Of course, the impeller can be formed of vanes, bores, or other assemblies known in the art.

The rotation of the impeller 22 draws molten metal into the inlet 48 and into the pump chamber 18. Continued rotation of the impeller 22 causes molten metal to be forced out of the pump chamber 18 to an outlet 50. Molten metal can be directed through outlet 50 to a piping assembly in fluid communication with a mold or other receptacle.

In one embodiment, a bypass gap 62 is interposed between a portion of the first bearing ring 38 and the first radial edge 38. The bypass gap 62 is a radial space interposed between at least a portion of the first bearing ring 38 and the first radial edge 34. The bypass gap 62 is a space through which molten metal is intentionally leaked from the pump chamber 18 of the base member 20. The bypass gap can be located in either the top or the bottom of the base member, but locating the bypass gap in the bottom surface may be preferred to direct the majority of "leaked" molten metal towards the furnace floor.

A lubrication gap 60 is provided between the second radial edge 32 and the second bearing ring 36. The lubrication gap has a dimensional space sized to predominately retain a layer of molten metal that provides a low friction boundary to support rotation of the impeller and prevent wobble. The width of the lubrication gap can vary based upon the constituents of the relevant molten alloy.

It is contemplated that the bypass gap will have a width (i.e. a distance between the impeller and the base and/or the bearing ring thereof) of at least about 1.2× the lubrication gap, or between about 1.5 and 6× the lubrication gap, or between about 2 and 4× the lubrication gap or any combination of such ranges.

The bypass gap 62 is operative to manipulate a flow rate and a head pressure of the molten metal discharged from the pump. The bypass gap 62 allows molten metal to leak from the pump chamber 18 to an environment outside of the base member 20 at a predetermined rate. The leakage of molten metal from the pump chamber 18 during the operation of the pump assembly 10 allows an operator to finely tune the flow rate or volumetric amount of molten metal provided to an associated mold. The leakage rate of molten metal through the bypass gap 62 improves the controllability of the transport of the molten metal.

In one embodiment, the pump assembly includes an ability to statically position molten metal pumped through the outlet 50 and into a riser at approximately 1.5 feet of head pressure above the bath of molten metal in which the pump resides. In one embodiment, the impeller rotates approximately 850-1000 rotations per minute such that molten metal is statically held at approximately 1.5 feet above a bath of the molten metal. The bypass gap manipulates the volumetric flow rate and head pressure relationship of the pump such that an increased amount of rotations per minute of the impeller would allow the reduction of head pressure as the flow rate of molten metal is increased.

A command RPM profile can be programmed into a controller to electrically communicate with the motor to rotate the impeller and force molten metal through the outlet and into the metal delivery conduit to an associated mold based upon a desired volumetric fill rate established by the geometry of the associated mold.

Figure 2:
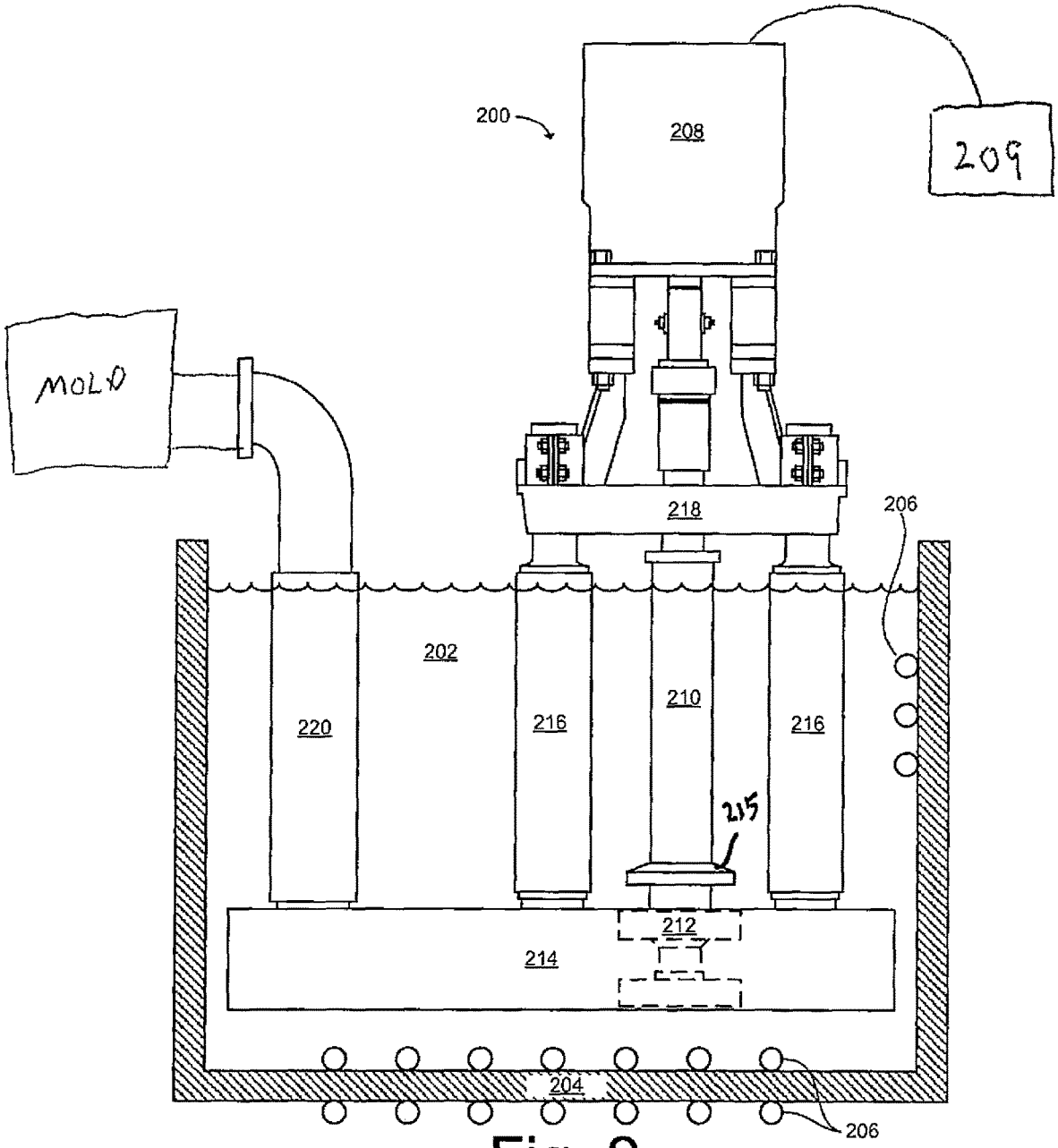
Fig. 2 (Prior Art)
FIG. 2 illustrates a side view of a prior art pump assembly configured to controllably deliver molten metal to a mold, the pump assembly shown from a cross sectional view of a holding furnace housing the pump assembly therein.
Figure 3:
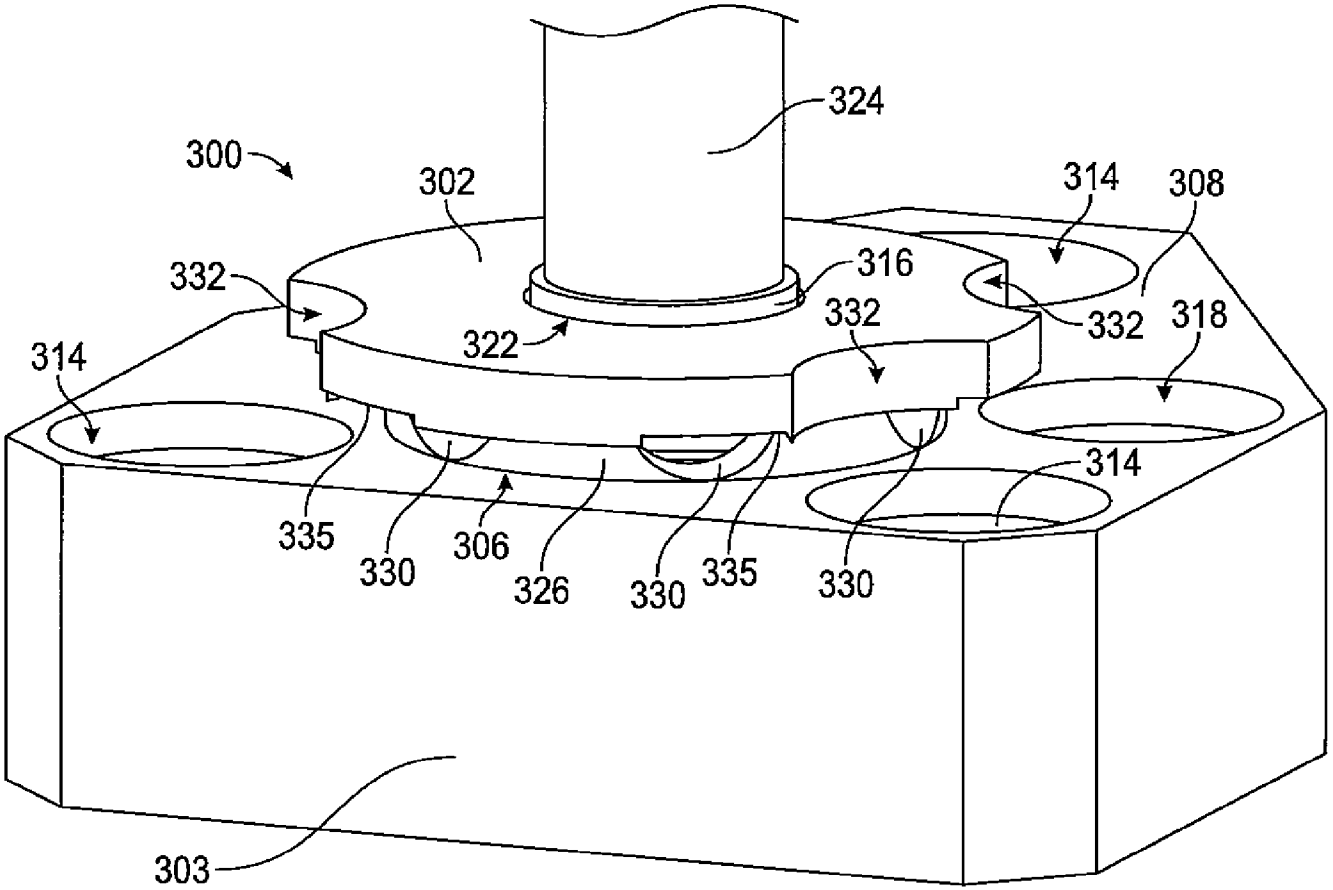
FIG. 3 illustrates a molten metal pump of the present invention.
Figure 4:
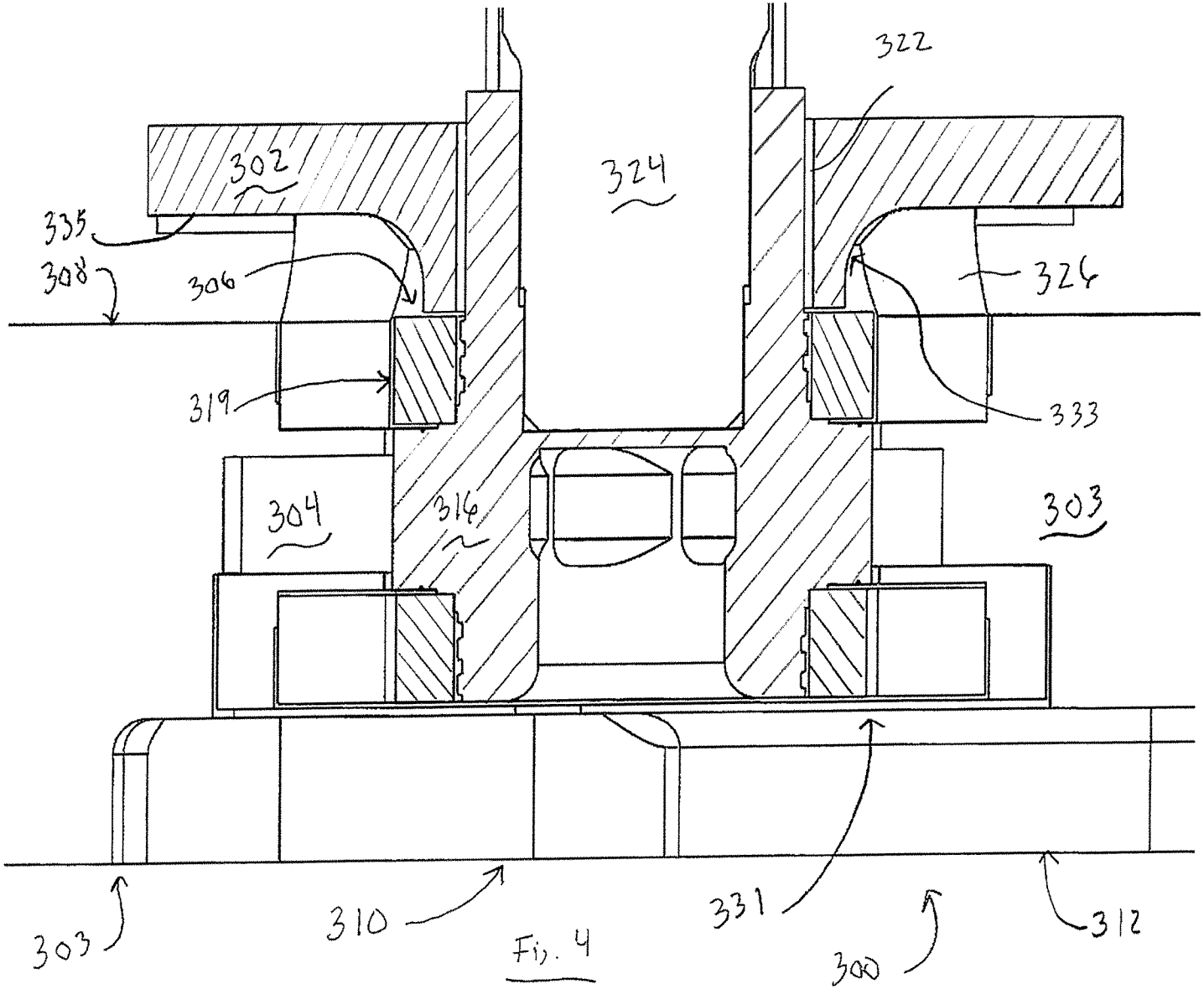
FIG. 4 is a partial cross-sectional view of the impeller region of the pump assembly of FIG. 3.

Referring to FIG. 2, a centrifugal molten metal pump assembly 200 suitable for use in an exemplary environment of the present disclosure is illustrated. The pump assembly shown in detail in FIG. 1, as modified in accord with the disclosure of FIGS. 3 and 4, is well suited to the environment and application of FIG. 2. Pump assembly 200 is shown from a side view submerged in a bath of molten metal 202 which is contained in holding furnace 204. Each of the components of the pump disposed below the molten metal line can be formed of a refractory material such as graphite or ceramic.

The molten metal 202 may be maintained in its molten or liquid state by heating elements 206 disposed in any suitable location around the holding furnace 204. For example, the heating elements 206 may be disposed along the side of the holding furnace 204, or underneath the holding furnace 204. In such a configuration, the molten metal 202 is heated to maintain the molten metal 202 in liquid form. In certain embodiments, the holding furnace may include a lid making it a closed environment.

The pump assembly 200 comprises a motor 208 coupled to a rotatable elongated shaft 210. The motor 208 is configured to be run at variable speeds with a programmable controller 209. The programmable controller may be suitably programmed or otherwise configured to execute computer-executable instructions according to a programmable control profile stored in computer-readable memory which causes a rotational speed of an impeller 212 to vary according to a control profile.

Additionally, or alternatively, the controller may be part of a feedback control system or closed-loop control system to monitor the fill status of a mold via sensors which may be situated in the mold and configured to monitor the fill status of the mold. These sensors may be probes, or any similar monitoring mechanism capable of monitoring a property associated with filling the mold and sending feedback signals to the controller. In this scenario, a desired system output for filling a mold may be specified and may vary over time according to the programmable fill profile. In some embodiments, the controller is a proportional-integral-derivative (PID) controller, suitable for feedback control systems. The controller can take the error (i.e., difference) between the desired system output and the measured system output and adjust the command voltage to the motor 208 in order to operate the impeller at a desired rotational speed for maintaining the desired system output.

With continuing reference to FIG. 2, the elongated shaft 210 is coupled to the impeller 212, which is located in a chamber, or housing, of a base member 214. The base member 214 is suspended by a plurality of refractory support posts 216 securely coupled to a platform 218 and is submerged in the bath of molten metal 202. Alternatively, a central support tube may be employed to suspend the base member, or a support post may be employed wherein an elongated metal (e.g., steel) rod surrounded by a protective refractory sheath extends between the platform and the base member.

In some embodiments, the elongated shaft 210 comprises a cylindrically shaped, elongated orientation having a rotational axis that is generally perpendicular to the base member 214. The elongated shaft 210 includes a proximal end that is configured to couple to the motor 208, and a distal end that is configured to couple to the impeller 212. The elongated shaft 210 is configured to be rotated by the motor 208 and extends from the motor 208 and into the chamber of the base member 214 such that the impeller 212 is rotated by the elongated shaft 210 and within the chamber of the base member 214. Elongated shaft 210 includes a plate 215 for deflating objects in a top feed pump design. Generally speaking, plate 215 is not satisfactory for purpose of the present disclosure because as a component of the shaft it must have an outer diameter (OD) equal to or less than the diameter of the impeller to allow installation through the bottom of the pump base. A plate of that size is not adequate for covering/diverting the molten metal that leaks from the top bearing(s). Accordingly, it is desirable that the diverter plate have an OD larger than the diameter of the impeller. Furthermore, since plate 215 rotates with the shaft it can cause turbulence on the surface of the molten metal bath.

Rotation of the impeller 212 therein causes a directed flow of the molten metal 202 by drawing the molten metal 202 into the chamber via an inlet of the base member 214, and forcing the molten metal 202 out of the chamber via an outlet of the base member 214. The outlet of the base member 214 may be disposed in any suitable location on the base member 214 and is typically adjacent a side wall or top wall of the base member 214.

The outlet of the base member 214 may be coupled to a riser 220 for transfer of the molten metal 202 to an associated transfer system, and subsequently to a mold. The associated transfer system typically comprises a system of pipes (or a launder) adapted for fluid communication that also maintain the molten metal 202 at a desired temperature while it is transferred through the transfer system.

Referring now to FIGS. 3 and 4, the molten metal pump 300 has been equipped with a flow diverter 302. Moreover, it has been found that at low metal bath levels in the furnace, and/or at high RPM or pressure, unwanted dross may form on the surface of the molten metal bath. Without being bound by theory, it is believed that while some level of molten metal may pass through the lubrication gap during operation of the pump, the quantity of molten metal passing through the lubrication gap increases at high impeller RPM and during high pressure mold fill. This increased discharge of molten metal through the lubrication gap, particularly at a low molten metal bath level, can cause dross formation. The flow diverter 302 can help prevent such unwanted oxidation.

Pump 300 includes of a base member 303 defining a pumping chamber 304. The pumping chamber 304 includes an opening 306 in a top surface 308 and an opening 310 in a bottom surface 312 of the base member 303. At least one post can extend between a motor mount and the base member 303 and is received in pockets 314. An impeller 316 is disposed in the pumping chamber 304 and is configured to draw molten metal through the opening 310 in the bottom surface 312 and expel the molten metal through outlet 318 in the base member 303. The flow diverter 302 is disposed above the opening 306 in the top surface 308.

The molten metal pump can include a bypass gap 331 and a lubrication gap 319 as described with respect to FIG. 1. The flow diverter 302 functions to disrupt the flow of molten metal exiting the opening 306 where a lubrication gap 319 is located. Moreover, the flow diverter 302 can disperse the flow of molten metal exiting the lubrication gap 319 before it reaches the surface of the molten metal bath in which the molten metal pump resides. Without the flow diverter undesirable surface turbulence can occur in the molten metal bath resulting in unwanted oxidation of the molten metal.

The diverter functions to reduce turbulence in the bath of molten metal caused by the expulsion of high-pressure molten metal through the lubrication gap (e.g. >10 psi.). The flow diverter 302 includes a passage 322 through which a shaft 324 extends. A spacer element 326 extends from the base member 303 and supports the flow diverter 302. The spacer element 326 can have a cylindrical body including passages 330. The flow diverter 302 can include an arcuate lower surface 333 to help direct lubrication gap metal flow radially outward. The flow diverter 302 can be substantially disc-shaped. The flow diverter 302 can include indentations 332 in its radial edge to receive posts and/or a riser.

In certain embodiments, the bottom surface of diverter 302 can include channels 335 that extend from adjacent passage 322 to a peripheral edge. Channels can encourage the smooth flow of molten metal laterally across the bottom surface of the diverter. In some embodiments the channels 335 can be radially aligned with the passages 330 in the space element 326. Similarly, in select embodiments the arcuate lower surfaces 333 can be radially aligned to form a transition zone between the passages 330 and the channels 335.

Without being bound by theory, it is contemplated that molten metal is expelled through the pump outlet, bypass gap and the opening in the top surface when a pressure in the pumping chamber exceeds 5 PSI, or 10 PSI, or 15 PSI higher. Alternatively, this feature can be expressed by a situation where the pressure in the pumping chamber is high enough to push molten metal through the outlet and bypass gap but not through the top surface because the dimension of the space between the impeller and the pumping chamber (i.e. the lubrication gap) is sufficiently narrow to resist molten metal flow.

Another way of expressing when there is significant discharge of molten metal through the lubrication gap can be based on impeller RPM. Moreover, the pump can operate at a first RPM wherein no significant amount of molten metal passes through the lubrication gap and a second RPM where molten metal is expelled through each of the outlet, the bypass gap and the opening in the top surface (e.g. the lubrication gap).

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molten metal pump comprised of a base member defining a pumping chamber, said base member including an opening in a top surface and an opening in a bottom surface, said openings being in fluid communication with the pumping chamber, at least one post extending between a motor mount and the base member, an impeller disposed in the pumping chamber and configured to draw molten metal through the opening in the bottom surface and expel the molten metal through an outlet in the base member, and a flow diverter disposed above the opening in the top surface wherein the flow diverter includes a passage through which a shaft extends, said shaft engaging the impeller at a first end and a motor at a second end.

2. The molten metal pump of claim 1 further comprising a spacer element extending from the base member and supporting said flow diverter.

3. The molten metal pump of claim 2 wherein the spacer element comprises a cylindrical body including at least one passage.

4. The molten metal pump of claim 1 including a bypass gap between a radial edge of the impeller and the opening in the bottom surface.

5. The molten metal pump of claim 4 including a lubrication gap between a radial edge of the impeller and the opening in the top surface.

6. The molten metal pump of claim 1 wherein the flow diverter is substantially disc-shaped.

7. The molten metal pump of claim 1 wherein a surface of the flow diverter facing the pumping chamber includes an arcuate surface.

8. The molten metal pump of claim 6 wherein the flow diverter includes at least one indentation in a radial edge configured to receive one of the at least one post.

9. The molten metal pump of claim 1 wherein each of the base member, impeller and diverter are comprised of a refractory material.

10. A method of pumping molten metal comprised of providing a molten metal pump having a base member defining a pumping chamber, said base member including an opening in a top surface and an opening in a bottom surface, said openings being in fluid communication with the pumping chamber, an impeller disposed in the pumping chamber, wherein rotation of the impeller draws molten metal through the opening in the bottom surface and expels molten metal through an outlet in the base member when operated at 200 RPM or lower and also expels the molten metal through the opening in the top surface when operated at 500 RPM or higher, and wherein a flow diverter disposed above the opening in the top surface directs molten metal passing through the opening in the top surface laterally, said flow diverter having a diameter greater than a diameter of said impeller.

11. The method of claim 10 wherein molten metal is expelled through the opening in the top surface when a pressure in the pumping chamber reaches 5 PSI or higher.

12. The method of claim 10 being performed to fill a mold.

13. A molten metal pump comprised of a base member defining a pumping chamber, said base member including an opening in a top surface and an opening in a bottom surface, said openings being in fluid communication with the pumping chamber, at least one post extending between a motor mount and the base member, an impeller disposed in the pumping chamber and configured to draw molten metal through the opening in the bottom surface and expel the molten metal through an outlet in the base member, and a flow diverter supported above the opening in the top surface by a spacer element, the spacer element comprised of a cylindrical body including passages therethrough.

14. The molten metal pump of claim 13 wherein the spacer element is secured to an interior surface of the opening in the top surface of the base member.

15. The molten metal pump of claim 13 wherein a lower surface of the flow diverter includes channels.

16. The molten metal pump of claim 15 wherein at least several channels are radially aligned with said passages.

17. A molten metal pump comprised of a base member defining a pumping chamber, said base member including an opening in a top surface and an opening in a bottom surface, said openings being in fluid communication with the pumping chamber, at least one post extending between a motor mount and the base member, an impeller disposed in the pumping chamber and configured to draw molten metal through the opening in the bottom surface and expel the molten metal through an outlet in the base member, and a flow diverter disposed above the opening in the top surface, wherein the flow diverter includes at least one indentation in a radical edge configured to receive one of the at least one post.

* * * * *